US006653921B2

(12) United States Patent
Nishijima et al.

(10) Patent No.: US 6,653,921 B2
(45) Date of Patent: Nov. 25, 2003

(54) MAGNETIC MEMBER FOR ELECTROMAGNETIC DRIVING DEVICE AND MANUFACTURING METHOD THEREOF

(75) Inventors: Yoshiaki Nishijima, Toyokawa (JP); Yurio Nomura, Nagoya (JP); Yasuyoshi Suzuki, Chiryu (JP)

(73) Assignee: Denso Corporation, Kariya (JP)

( * ) Notice: Subject to any disclaimer, the term of this patent is extended or adjusted under 35 U.S.C. 154(b) by 2 days.

(21) Appl. No.: 10/246,768

(22) Filed: Sep. 19, 2002

(65) Prior Publication Data

US 2003/0058072 A1 Mar. 27, 2003

(30) Foreign Application Priority Data

Sep. 21, 2001 (JP) ..... 2001-289147
Mar. 5, 2002 (JP) ..... 2002-058653

(51) Int. Cl.[7] ..... H01F 3/00
(52) U.S. Cl. ..... 335/297; 336/234; 29/609
(58) Field of Search ..... 335/281, 296, 335/297; 336/233, 234; 29/602.1, 607, 609

(56) References Cited

U.S. PATENT DOCUMENTS 5,097,373 A * 3/1992 Yuki ..... 360/126

FOREIGN PATENT DOCUMENTS

| | | |
|---|---|---|
| JP | 2001-50103 | 2/2001 |
| JP | 2001-65319 | 3/2001 |
| JP | 2001-143217 | 5/2001 |
| JP | 2001-182564 | 7/2001 |

* cited by examiner

*Primary Examiner*—Ramon M. Barrera
(74) *Attorney, Agent, or Firm*—Nixon & Vanderhye P.C.

(57) ABSTRACT

A first core is formed by stacking a plurality of magnetic plates of a soft magnetic material, such as iron, in a direction perpendicular to a plane of each magnetic plate. A bonding thin layer made of iron oxide having a thickness of approximately a few nanometers to a few hundred micrometers is formed between adjacent ones of the magnetic plates. The adjacent magnetic plates are bonded to each other by diffusion bonding in such a manner that the bonding thin layer is interposed between the adjacent magnetic plates to electrically insulate between the adjacent magnetic plate.

20 Claims, 5 Drawing Sheets

MAGNETIC MEMBER FOR ELECTROMAGNETIC DRIVING DEVICE AND MANUFACTURING METHOD THEREOF

CROSS REFERENCE TO RELATED APPLICATION

This application is based on and incorporates herein by reference Japanese Patent Application No. 2001-289147 filed on Sep. 21, 2001 and Japanese Patent Application No. 2002-058653 filed on Mar. 5, 2002.

BACKGROUND OF THE INVENTION

1. Field of the Invention

The present invention relates to a magnetic member for an electromagnetic driving device and a manufacturing method thereof.

2. Description of Related Art

In one previously proposed electromagnetic driving device, a movable core is attracted toward a stationary core when a corresponding coil wound around the stationary core is energized to generate a magnetic flux in a magnetic circuit. Such an electromagnetic driving device is widely used, for example, in a flow control valve, which opens and closes a flow passage by a valve member that reciprocates integrally with the movable core.

When the coil is energized, a density of the magnetic flux, which flows through the magnetic circuit formed by the stationary core and the movable core, increases. However, for example, as shown in FIG. 12, when the density of the magnetic flux increases, an eddy current 310 flows through the stationary core 300. The eddy currents 310 flow in such a manner that the eddy currents 310 reduce the density of the magnetic flux in the stationary core 300. Thus, a magnetic force of the stationary core 300, which attracts the movable core is reduced.

In order to restrain such a reduction in the magnetic force caused by the eddy currents, i.e., to reduce the eddy current loss, it has been proposed to form slits in the stationary core and/or the movable core to interrupt the region, through which the eddy current flows. However, the slits reduce a surface area of the magnetic passage, resulting in a reduction in the magnetic force.

Apart from the magnetic member for the electromagnetic driving device, Japanese Unexamined Patent publication No. 2001-143217 discloses a magnetic head. The magnetic head includes a metal magnetic film. The metal magnetic film is made of metal magnetic layers and insulation layers, which are alternately stacked through various thin film forming techniques, such as an sputtering process and a vacuum deposition process, in order to reduce eddy current loss in the metal magnetic film. The insulation layers are provided to reduce the eddy currents generated in the metal magnetic film, thereby reducing the eddy current loss.

However, the thin film forming techniques, such as the sputtering process and the vacuum deposition process, can only provide a relatively thin metal magnetic film. As a result, it is difficult to form a magnetic member that requires a relatively large magnetic passage surface area, such as the stationary core and the movable core used in the electromagnetic driving device of the flow control valve, by the thin film forming techniques, such as the sputtering process and the vacuum deposition process.

SUMMARY OF THE INVENTION

Thus, it is an objective of the present invention to provide a magnetic member for an electromagnetic driving device for generating a magnetic attracting force of a desired magnitude without substantially increasing its size. It is another objective of the present invention to provide a manufacturing method of such a magnetic member.

To achieve the objectives of the present invention, there is provided a magnetic member, which forms at least part of a magnetic circuit of an electromagnetic driving device. The magnetic member includes a plurality of magnetic portions and a plurality of bonding thin layers, each of which is interposed between corresponding adjacent ones of the magnetic portions to join the adjacent ones of the magnetic portions. A volume resistivity of each bonding thin layer is greater than that of iron. The adjacent ones of the magnetic portions are joined together by diffusion bonding in such a manner that the corresponding bonding thin layer is interposed between the adjacent ones of the magnetic portions.

To achieve the objectives of the present invention, there is provided a method for manufacturing a magnetic member for an electromagnetic driving device. In the method, a plurality of magnetic material bodies, each of which has a magnetic portion, is provided. A bonding thin layer, which has a volume resistivity greater than that of iron, is formed on one or more surfaces of each of at least one of the magnetic material bodies. A structure, which has a predetermined shape, is constructed from the magnetic material bodies in such a manner that the bonding thin layer of each of the at least one of the magnetic material bodies is interposed between each of the at least one of the magnetic material bodies and one or more corresponding adjacent magnetic material bodies. Then, each of the at least one of the magnetic material bodies is joined to the one or more corresponding adjacent magnetic material bodies in such a manner that the bonding thin layer of each of the at least one of the magnetic material bodies is interposed between each of the at least one of the magnetic material bodies and the one or more corresponding adjacent magnetic material bodies. The joining of each of the at least one of the magnetic material bodies to the one or more corresponding adjacent magnetic material bodies is accomplished at least by placing the structure in an enclosed space, evacuating the enclosed space, and inducing diffusion between each of the at least one of the magnetic material bodies and the one or more corresponding adjacent magnetic material bodies.

To achieve the objectives of the present invention, there is further provided a method for manufacturing a magnetic member for an electromagnetic driving device. In the method, a structure, which has a predetermined shape, is constructed from a plurality of magnetic material bodies. Then, adjacent ones of the magnetic material bodies are joined together in such a manner that a corresponding oxidized thin layer is interposed between the adjacent ones of the magnetic material bodies. Each oxidized thin layer has a volume resistivity greater than that of iron. The joining of the adjacent ones of the magnetic material bodies is accomplished at least by placing the structure in an enclosed space, supplying oxygen gas into the enclosed space, evacuating the enclosed space, and heating the structure to induce diffusion between the adjacent ones of the magnetic material bodies.

To achieve the objectives of the present invention, there is also provided a method for manufacturing a magnetic member for an electromagnetic driving device. In the method, a structure, which has a predetermined shape, is constructed from a plurality of magnetic material bodies. Then, adjacent ones of the magnetic material bodies are joined together in such a manner that a corresponding nitrided thin layer is interposed between the adjacent ones of the magnetic material bodies. Here, each nitrided thin layer has a volume resistivity greater than that of iron. The joining of the adjacent ones of the magnetic material bodies is accomplished at least by placing the structure in an enclosed space, supplying nitrogen gas into the enclosed space, evacuating the enclosed space, and inducing diffusion between the adjacent ones of the magnetic material bodies.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Various embodiments of the present invention will be described with reference to the accompanying drawings.

(First Embodiment)

Figure 2:
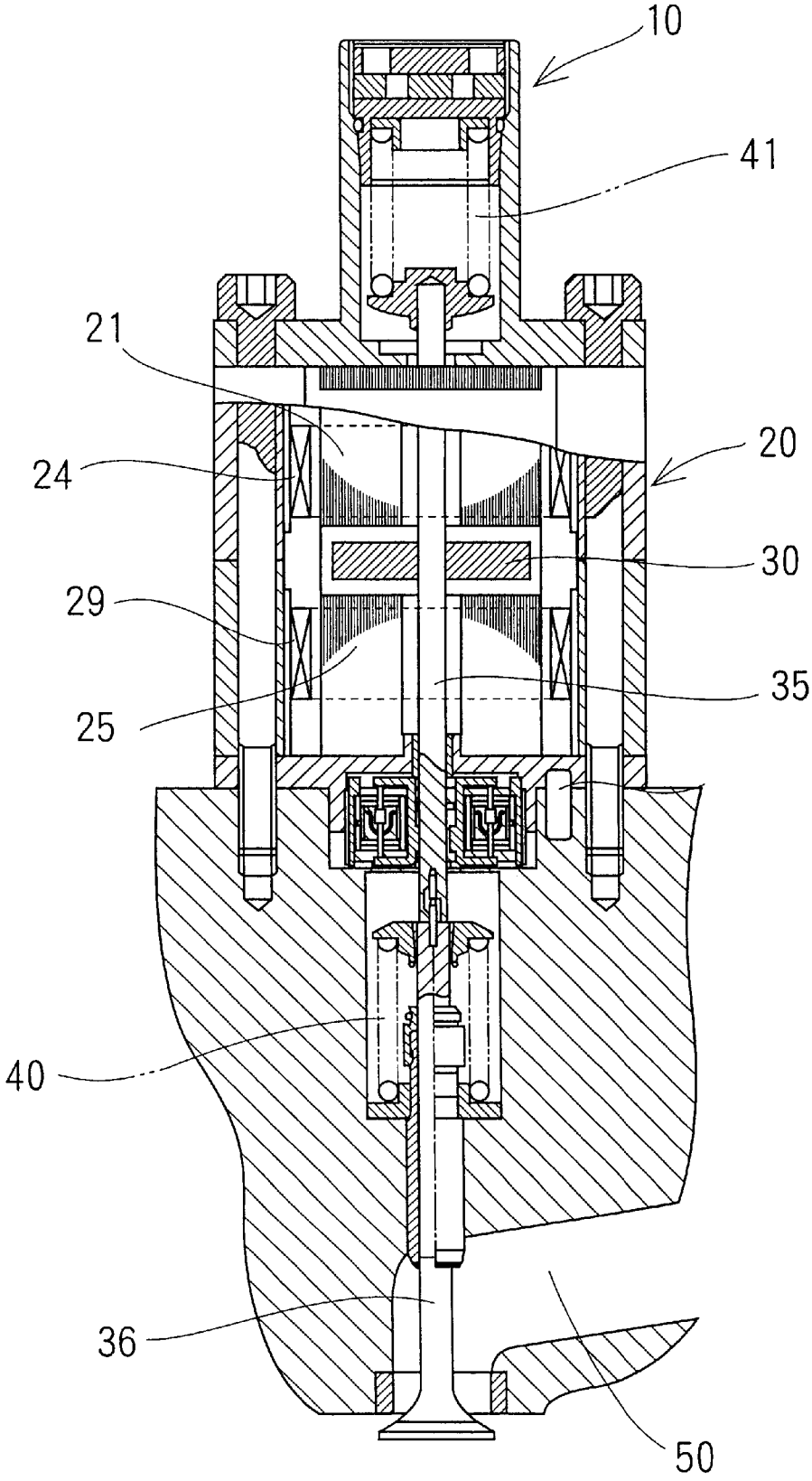
FIG. 2 is a cross-sectional view showing an intake valve device, in which the magnetic member for the electromagnetic driving device according to the first embodiment is implemented.

In a first embodiment of the present invention, a magnetic member for an electromagnetic driving device is implemented in an intake valve device shown in FIG. 2.

With reference to FIG. 2, an intake valve device 10 is a solenoid valve device, which opens and closes an air intake passage 50. An electromagnetic driving device 20 includes a first core 21 and a second core 25, which are respectively placed above and below an armature 30. A first coil 24 is wound around the first core 21, and a second coil 29 is wound around the second core 25. The first core 21, the second core 25, or the armature 30 corresponds to the magnetic member for the electromagnetic driving device of the invention.

The armature 30 reciprocates integrally with a shaft 35 and a valve member 36 connected to the shaft 35. A spring 40 urges the armature 30, the shaft 35 and the valve member 36 in an upward direction in FIG. 2, i.e., in a direction of closing the air intake passage 50. Another spring 41 urges the armature 30, the shaft 35 and the vale member 36 in a downward direction in FIG. 2, i.e., in a direction of opening the air intake passage 50.

When the first coil 24 and the second coil 29 are both deenergized, the valve member 36 is placed in the position shown in FIG. 2 where the force of the spring 40 and the force of the spring 41 are balanced. In the state shown in FIG. 2, the air intake passage 50 is slightly opened.

When the first coil 24 is energized, and the second coil 29 is deenergized, the armature 30 is attracted to the first core 21, and thus the valve member 36 moves in the upward direction in FIG. 2. As a result, the air intake passage 50 is closed. On the other hand, when the first coil 24 is deenergized, and the second coil 29 is energized, the armature 30 is attracted to the second core 25, and thus the valve member 36 moves in the downward direction in FIG. 2. As a result, the air intake passage 50 is opened.

Figure 1:
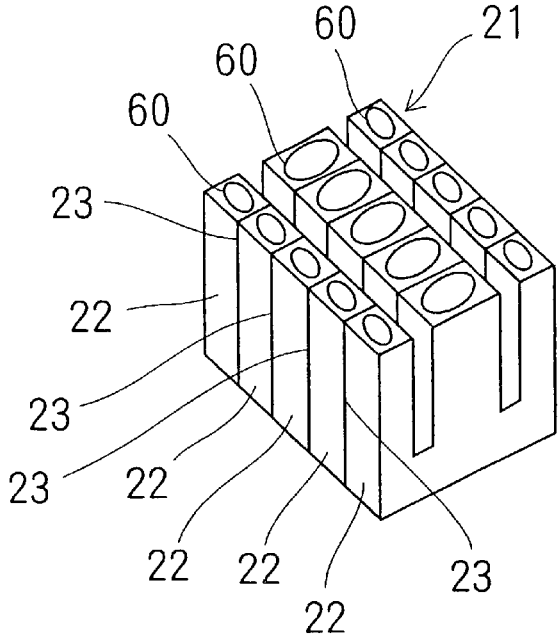
FIG. 1 is a schematic view showing a magnetic member for an electromagnetic driving device according to a first embodiment of the present invention.

As shown in FIG. 1, the first core 21 includes a plurality of magnetic plates 22, which are made of soft magnetic material, such as iron and are stacked in a thickness direction of each magnetic plate 22 (that is, a direction perpendicular to a plane of each magnetic plate 22). Each bonding thin layer 23, which has a thickness ranging between about a few nanometers and about a few hundred micrometers, is interposed between the adjacent magnetic plates 22, which serve as magnetic portions. Each bonding thin layer 23 is an oxidized thin layer made of iron oxide (or oxide of any other suitable element that has a bonding force for bonding with an oxygen atom equal to or less than that of iron). The adjacent magnetic plates 22 are joined together by diffusion bonding in such a manner that the corresponding bonding thin layer 23 is interposed between the adjacent magnetic plates 22.

Figure 3:
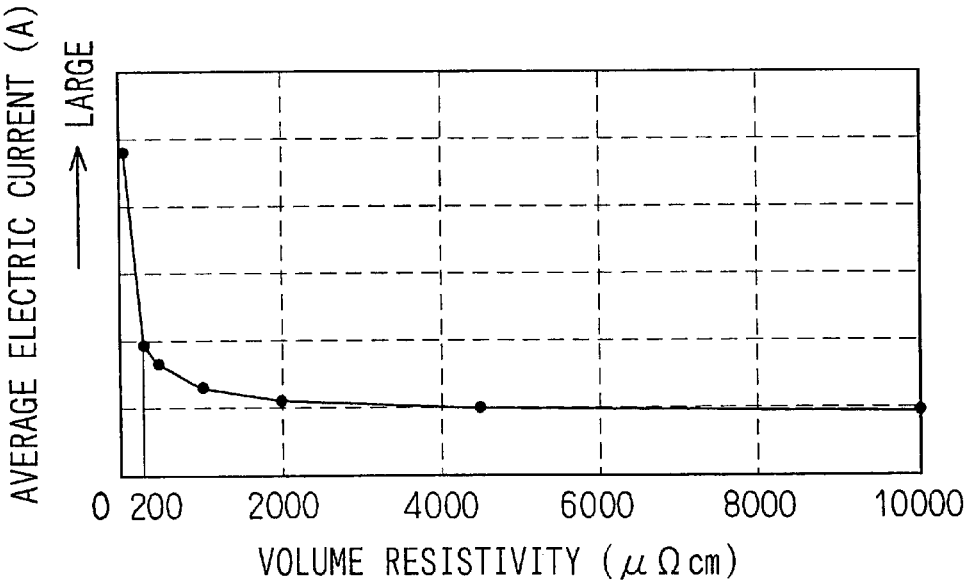
FIG. 3 is a graph showing a relation between a volume resistivity of a bonding thin layer and an average electric current required to generate a magnetic force.

A volume resistivity of the bonding thin layer 23 should be greater than that of iron, and for example, 200 micro-ohm-centimeters ($\mu\Omega$cm) or greater is sufficient as the volume resistivity of the bonding thin layer 23. As shown in FIG. 3, when the volume resistivity of the bonding thin layer 23 is equal to or greater than 200 $\mu\Omega$cm, an average electric current, which is required to generate a given magnetic force, is substantially reduced. In other words, it should be understood that the generated eddy current is reduced, and thus the eddy-current loss is accordingly reduced.

When the first coil 24 is energized, and thus the density of the magnetic flux, which passes through the first core 21, starts to increase, eddy current 60 flows in a direction of suppressing the increase of the density of the magnetic flux. However, since the magnetic plates 22 are stacked in such a manner that the corresponding bonding thin layer 23 is interposed between the adjacent magnetic plates 22, the area, through which the eddy current 60 flows, is interrupted by the bonding thin layers 23. As a result, the generated eddy current is reduced, and thus the eddy-current loss is accordingly reduced. Similar to the first core 21, it is preferred that each of the second core 25 and the armature 30 is formed of a plurality of stacked magnetic plates and a plurality of bonding thin layers, each of which is interposed between the corresponding adjacent magnetic plates.

Among a method for manufacturing the first core 21, a method for manufacturing the second core 25 and a method for manufacturing the armature 30, only the method for manufacturing the first core 21 will be described for the sake of simplicity. However, it should be noted that the method for manufacturing the second core 25 and the method for manufacturing the armature 30 are similar to the method for manufacturing the first core 21.

(1) Thin Layer Forming Step

Each basic material body, or magnetic material body, 100 (not shown in FIG. 4) is made of iron, which serves as the soft magnetic material, and is shaped into a plate form. Exposed surfaces of each basic material body 100 are oxidized to form a basic material body 110 (FIG. 4), which has a bonding thin layer of iron oxide in its exposed surfaces. The iron oxide formed in the surfaces of the basic material body 110 is diiron trioxide ($Fe_2O_3$).

(2) Structure constructing Step

Figure 4:
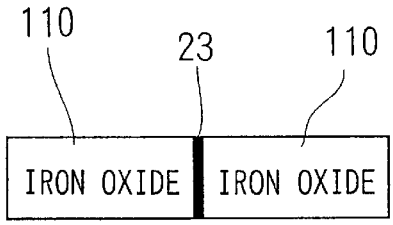
FIG. 4 is a schematic view showing one exemplary manufacturing method of the magnetic member for the electromagnetic driving device according to the first embodiment.

The basic material bodies 110, each of which has the bonding thin layer formed in its surfaces, are stacked in the thickness direction (direction perpendicular to the plane) of each basic material body 110. Thus, the adjacent basic material bodies 110 contact each other, as shown in FIG. 4, to form a structure having a predetermined shape.

(3) Joining Step

A receiving chamber (enclosed space), which receives the structure formed in the structure constructing step, is evacuated to make the pressure inside the receiving chamber close to the vacuum. At this time, it is preferred to heat the structure. Then, diffusion bonding is generated between the bonding thin layers of iron oxide, which are formed in the opposed surfaces of the adjacent basic material bodies 110, to bond or join the adjacent basic material bodies 110 together. Thus, a bonding thin layer 23 of iron oxide, which has a thickness ranging between about a few nanometers and about a few hundred micrometers, is now formed between the adjacent basic material bodies 110.

(4) Cutting Step

Unnecessary iron oxide is removed from the structure by cutting the surfaces of the structure except the connections between the adjacent basic material bodies 110 to form the first core 21.

Figure 5:
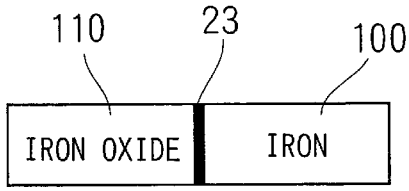
FIG. 5 is a schematic view showing another exemplary manufacturing method of the magnetic member for the electromagnetic driving device according to the first embodiment.

With reference to FIG. 5, as a modification of the above embodiment, the basic material body 110, which has the bonding thin layer of iron oxide on its exposed surfaces, can be used as one of each adjacent pair of basic material bodies to be joined, and the basic material body 100, which has no bonding thin layer, can be used as the other one of the pair of basic material bodies. Even in such a case, the bonding thin layer 23 of iron oxide is formed between the adjacent basic material bodies 100, 110, and thus the adjacent basic material bodies 100, 110 are joined together by the diffusion bonding.

In the cases of FIGS. 4 and 5 where each bonding thin layer 23 is made of the iron oxide, it could happen that the volume resistivity of the bonding thin layer 23 is reduced due to diffusion of oxygen into the iron portion, which acts as the magnetic portion, of each corresponding basic material body 100, 110 from the bonding thin layer 23, which connects between the corresponding basic material body 110 and the other corresponding basic material body 110 or which connects between the corresponding basic material body 100 and the other corresponding basic material body 110. When the volume resistivity of the bonding thin layer 23 is reduced, the eddy current reducing effect is reduced.

Figure 6:
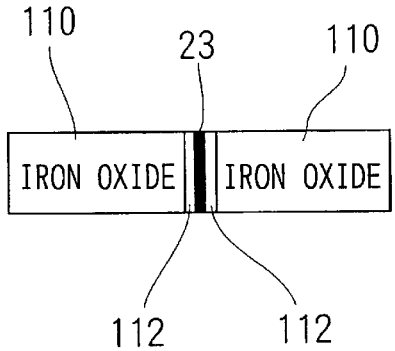
FIG. 6 is a schematic view showing another exemplary manufacturing method of the magnetic member for the electromagnetic driving device according to the first embodiment.

Thus, in order to restrain the diffusion of oxygen into the magnetic portion from the bonding thin layer 23, it is desirable to form an oxygen-diffusion restraining layer 112 (FIG. 6) in a boundary between the bonding thin layer and the magnetic portion of the basic material body 110 in the case of the basic material body 110 in a manufacturing step performed before the structure constructing step. In the case of the basic material body 100, it is desirable to form the oxygen-diffusion restraining layer 112 in the contact surface, which contacts with the bonding thin layer of the adjacent basic material body 110, in the manufacturing step performed before the structure constructing step.

Each oxygen-diffusion restraining layer 112 should be made of an element, which has a larger bonding force for forming a bond with an oxygen atom in comparison to iron. Such an element includes, for example, aluminum (Al), hafnium (Hf) or silicon (Si), or an oxide of aluminum, hafnium, or silicon. The oxygen-diffusion restraining layer 112 is formed by implanting aluminum, hafnium or silicon into each corresponding basic material body 100 by ion implantation. When the basic material body 100, into which aluminum, hafnium or silicon is implanted, is oxidized, the basic material body 110, which has the bonding thin layer made of iron oxide on its surfaces, is manufactured. Here, when the basic material body 100, into which aluminum, hafnium or silicon is implanted, is oxidized, occurrence of oxidization of aluminum, hafnium or silicon is permitted. Since the aluminum, hafnium or silicon has the greater bonding force for forming a bond with an oxygen atom in comparison to iron, the diffusion of oxygen from the bonding thin layer 23 made of the iron oxide toward the magnetic portion is restrained by the oxygen-diffusion restraining layer 112. The oxygen-diffusion restraining layer 112 restrains the reduction of the volume resistivity of the bonding thin layer 23.

Figure 7:
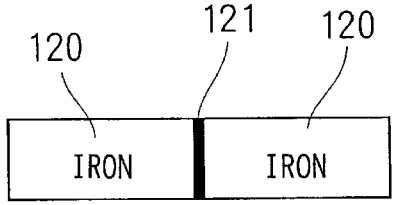
FIG. 7 is a schematic view showing another exemplary manufacturing method of the magnetic member for the electromagnetic driving device according to the first embodiment.

In place of the basic material bodies 100, 110, a basic material body 120, which has a bonding thin layer made of silicon oxide, can be used. The bonding thin layer made of silicon oxide can be formed by oxidizing silicon containing iron, which has relatively high silicon content. With reference to FIG. 7, a structure, which has a bonding thin layer 121 made of silicon oxide, can be formed by bonding the adjacent basic material bodies 120 by the diffusion bonding. Since silicon has the greater bonding force for forming a bond with an oxygen atom in comparison to iron, it is not necessary to form an oxygen-diffusion restraining layer in a boundary between the bonding thin layer 121 and the magnetic portion. In stead of implanting silicon in iron, an element, such as aluminum or hafnium, which forms a stable oxide, can be implanted into iron. The iron, into which aluminum, hafnium or the like is implanted by ion implantation, is oxidized to form a basic material body, which has the bonding thin layer made of aluminum oxide, hafnium oxide or the like. This basic material body can be used in place of the above basic material bodies. In such a case, since aluminum or hafnium has a greater bonding force for forming a bond with an oxygen atom in comparison to iron, it is not necessary to form an oxygen-diffusion restraining layer in a boundary between the bonding thin layer and the magnetic portion. Here, other than the above described part, the manufacturing method is substantially the same as that of the cases shown in FIGS. 4 and 5.

Figure 8:
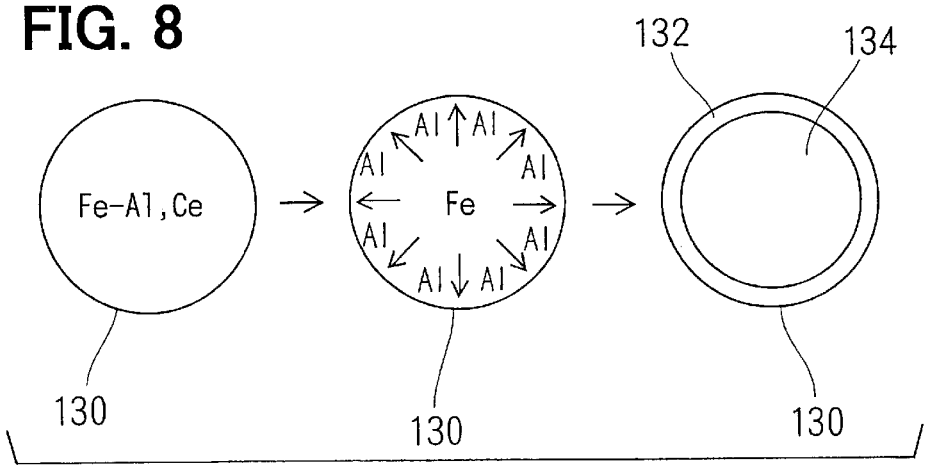
FIG. 8 is a schematic view showing another exemplary manufacturing method of the magnetic member for the electromagnetic driving device according to the first embodiment.

One of possible ways to form the bonding thin layer made of aluminum oxide on the surface of iron would be one that uses self-diffusion. With reference to FIG. 8, a basic material body 130 includes an iron-aluminum (Fe—Al) alloy, which contains cerium (Ce). The basic material body 130 is oxidized under high temperature. Since aluminum (Al) can be more easily diffused in comparison to iron (Fe), the aluminum is diffused over the surfaces of the basic material body 130. Thus, a bonding thin layer 132, which is made of aluminum oxide ($Al_2O_3$), is formed over the surfaces of the basic material body 130. Since the basic material body 130 includes cerium (Ce), the magnetic portion (Fe) 134 and the bonding thin layer ($Al_2O_3$) 132 of the basic material body 130 are strongly bonded to each other.

Figure 9:
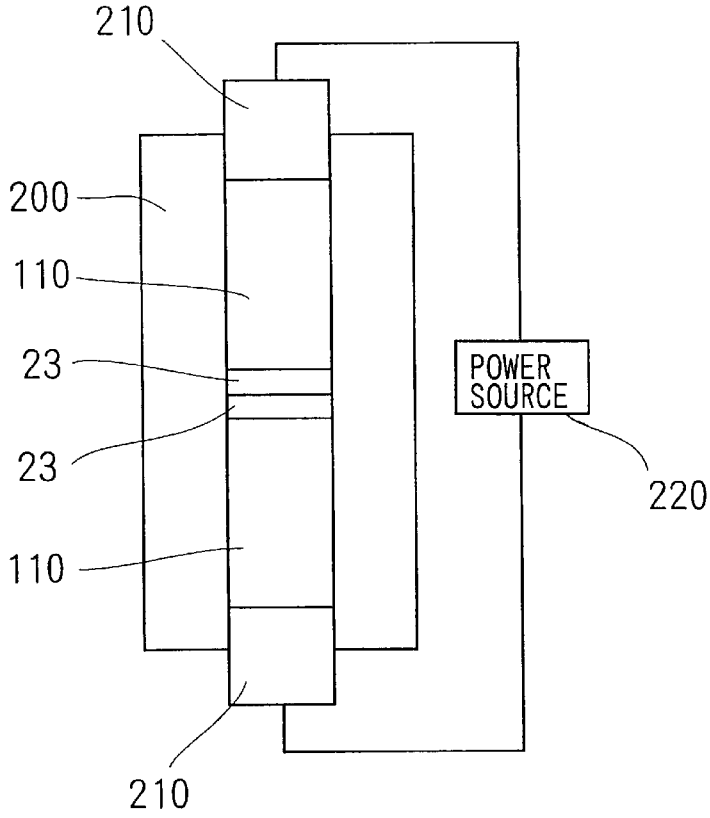
FIG. 9 is a schematic view showing a method for heating basic material bodies in a bonding step according to the first embodiment.

In the case of heating the basic material body in the joining step, it is desirable to heat the basic material bodies 110 by placing an electrical heating device 200 into close contact with the basic material bodies 110, as shown in FIG. 9. Punches 210 apply a pressure to the basic material bodies 110 and also act as electrodes for supplying electrical power to the electrical heating device 200 from a power source 220. A heating portion of the electrical heating device 200 is formed, for example, by sintering carbon powder particles. By controlling the frequency or the amount of the electric current supplied to the electrical heating device 200 from the power source 220, the temperature can be more precisely controlled in comparison to the case where the basic material bodies are heated in the atmosphere. Furthermore, the bonding step can be finished within a relatively short period of time.

Figure 10:
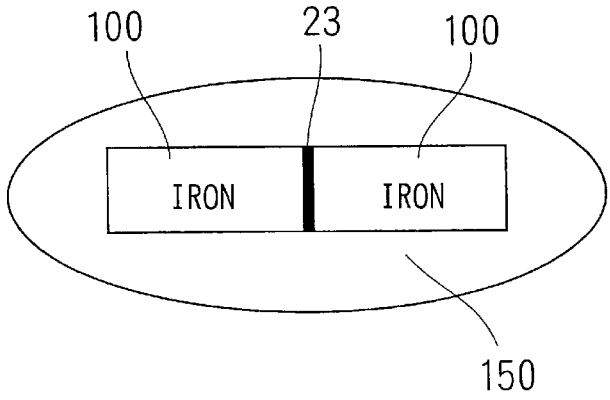
FIG. 10 is a schematic view showing another exemplary manufacturing method of the magnetic member for the electromagnetic driving device according to the first embodiment.

Also, as shown in FIG. 10, it is possible to bond the adjacent non-oxidized basic material bodies 100 to each other by diffusion bonding. This is accomplished in the following manner. That is, the non-oxidized basic material bodies 100 are stacked one after the other to form the structure. Then, oxygen gas is supplied into a receiving chamber (enclosed space) 150, which receives the structure. The receiving chamber 150 is evacuated to make the pressure inside the receiving chamber 150 close to the vacuum, and the structure is heated, so that the opposed contact surfaces of the adjacent basic material bodies 100 are bonded by the diffusion bonding while the opposed contact surfaces of the adjacent basic material bodies 100 are oxidized. The iron oxide, which is formed at the connection between the adjacent basic material bodies 100 in the receiving chamber 150 that has the oxygen atmosphere, changes from iron monoxide (FeO) to triiron tetraoxide ($Fe_3O_4$) and then to diiron trioxide ($Fe_2O_3$) as the heating temperature increases. The temperature should be increased to the level that causes formation of the diiron trioxide ($Fe_2O_3$), which is the dielectric material.

Instead of oxidizing the iron, the iron can be nitrided to form the bonding thin layer of iron nitride. Furthermore, instead of supplying oxygen gas into the receiving chamber 150 of FIG. 10, nitrogen gas can be supplied into the receiving chamber 150.

(Second Embodiment)

Figure 11:
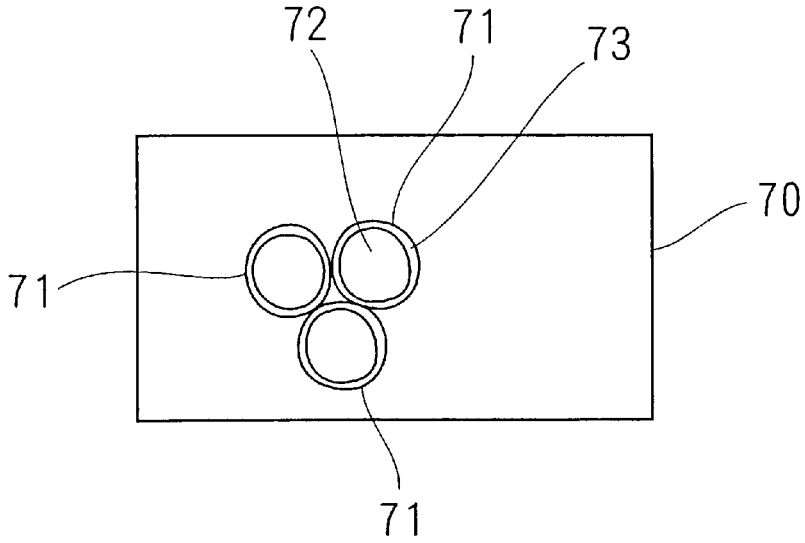
FIG. 11 is a schematic view showing an exemplary manufacturing method of a magnetic member for an electromagnetic driving device according to a second embodiment.
Figure 12:
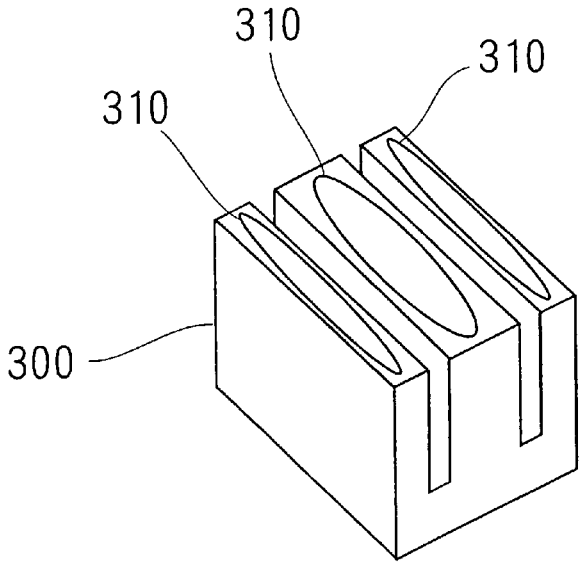
FIG. 12 RELATED ART
FIG. 12 is a schematic view showing a previously proposed magnetic member for an electromagnetic driving device.

A manufacturing method of the magnetic member according to a second embodiment of the present invention will be described with reference to FIG. 11.

(1) Iron powder particles, which act as the soft magnetic material, are oxidized to form magnetic particles (basic material bodies) 71, each of which has a bonding thin layer 73 of iron oxide formed around an iron particle 72.

(2) The magnetic iron particles 71 are sintered to form a structure 70 that has a desired shape.

(3) A receiving chamber (enclosed space), which receives the structure 70, is evacuated to make the pressure inside the receiving chamber close to the vacuum. At this time, it is desirable to heat the structure 70. Then, diffusion bonding is generated between the magnetic particles 71, so that the magnetic particles 71 are bonded or joined together. A bonding thin layer of iron oxide, which has a thickness of about a few micrometers, is formed between the adjacent magnetic particles 71.

In the second embodiment, the magnetic particles 71 are sintered to form the structure, so that there is a greater freedom in designing of a shape of the magnetic member to be manufactured.

In the above embodiments, the bonding thin layer is formed between the adjacent magnetic elements through the diffusion bonding of the adjacent magnetic elements in the vacuum. Thus, the generation of the eddy current is reduced, and thus the eddy current loss is reduced. Also, the reduction of the surface area of the magnetic passage of the manufactured magnetic member can be reduced. When the magnetic member according to the present invention is constructed to have the same size as that of the previously proposed magnetic member, the magnetic member according to the present invention will have the greater magnetic attractive force in comparison to that of the previously proposed magnetic member due to an increase in the amount of magnetic flux. Furthermore, when the magnetic member according to the present invention is constructed to generate the same magnetic attractive force as that of the previously proposed magnetic member, the magnetic member according to the present invention will have a smaller size. Thus, a size of the device that includes the magnetic member according to the present invention can be substantially reduced.

In the above-described manufacturing methods, it is essential to heat the structure when the basic material bodies of the structure are bonded together by the diffusion bonding in the oxygen atmosphere. Besides this, when the basic material bodies of the structure are bonded together by the diffusion bonding in the vacuum, it is desirable to heat the structure to increase the bonding strength between the adjacent basic material bodies by increasing the amount of diffusion at the connection between the adjacent basic material bodies.

Additional advantages and modifications will readily occur to those skilled in the art. The invention in its broader terms is therefore, not limited to the specific details, representative apparatus, and illustrative examples shown and described.

What is claimed is:

1. A magnetic member, which forms at least part of a magnetic circuit of an electromagnetic driving device, the magnetic member comprising:

a plurality of magnetic portions; and a plurality of bonding thin layers, each of which is interposed between corresponding adjacent ones of the magnetic portions to join the adjacent ones of the magnetic portions, wherein:

a volume resistivity of each bonding thin layer is greater than that of iron; and the adjacent ones of the magnetic portions are joined together by diffusion bonding in such a manner that the corresponding bonding thin layer is interposed between the adjacent ones of the magnetic portions.

2. A magnetic member according to claim 1, wherein a thickness of each bonding thin layer is within a range between a few nanometers and a few hundred micrometers.

3. A magnetic member according to claim 1, wherein the volume resistivity of each bonding thin layer is equal to or greater than 200 micro-ohm-centimeters.

4. A magnetic member according to claim 1, wherein:

each magnetic portion is in a form of a plate; and the magnetic portions are stacked in a direction perpendicular to a plane of each magnetic portion.

5. A magnetic member according to claim 1, wherein each magnetic portion is in a form a particle.

6. A magnetic member according to claim 1, wherein each bonding thin layer is an oxidized thin layer.

7. A magnetic member according to claim 6, wherein:

each oxidized thin layer includes an oxide of an element that has a bonding force for bonding with an oxygen atom greater than that of iron; and an oxygen-diffusion restraining layer is disposed in a boundary between each oxidized thin layer and each of the adjacent ones of the magnetic portions to restrain diffusion of oxygen from the oxidized thin layer to each of the adjacent ones of the magnetic portions.

8. A magnetic member according to claim 1, wherein each bonding thin layer is a nitrided thin layer.

9. A method for manufacturing a magnetic member for an electromagnetic driving device, the method comprising:

providing a plurality of magnetic material bodies, each of which has a magnetic portion;

forming a bonding thin layer, which has a volume resistivity greater than that of iron, on one or more surfaces of each of at least one of the magnetic material bodies;

constructing a structure, which has a predetermined shape, from the magnetic material bodies in such a manner that the bonding thin layer of each of the at least one of the magnetic material bodies is interposed between each of the at least one of the magnetic material bodies and one or more corresponding adjacent magnetic material bodies; and joining each of the at least one of the magnetic material bodies to the one or more corresponding adjacent magnetic material bodies in such a manner that the bonding thin layer of each of the at least one of the magnetic material bodies is interposed between each of the at least one of the magnetic material bodies and the one or more corresponding adjacent magnetic material bodies, wherein the joining of each of the at least one of the magnetic material bodies to the one or more corresponding adjacent magnetic material bodies includes:

placing the structure in an enclosed space;

evacuating the enclosed space; and inducing diffusion between each of the at least one of the magnetic material bodies and the one or more corresponding adjacent magnetic material bodies.

10. A method according to claim 9, wherein the volume resistivity of each bonding thin layer is equal to or greater than 200 micro-ohm-centimeters.

11. A method according to claim 9, wherein the inducing of the diffusion includes heating of the structure.

12. A method according to claim 11, wherein the heating of the structure includes heating of the structure by an electrical heating device, which is in close contact with the structure.

13. A method according to claim 9, wherein each bonding thin layer is an oxidized thin layer.

14. A method according to claim 13, wherein:

the forming of the bonding thin layer includes forming of each oxidized thin layer from an oxide of an element that has a bonding force for bonding with an oxygen atom equal to or less than that of iron;

before the constructing of the structure, forming an oxygen-diffusion restraining layer in a boundary between the magnetic portion and the bonding thin layer in each of the at least one of the magnetic material bodies; and also before the constructing of the structure, forming an oxygen-diffusion restraining layer on one or more surfaces of the magnetic portion of each magnetic material body that has no bonding thin layer only when the magnetic material bodies contain any magnetic material body that has no bonding thin layer.

15. A method according to claim 9, wherein each bonding thin layer is a nitrided thin layer.

16. A method according to claim 9, wherein:

each magnetic material body is in a form of a plate; and the constructing of the structure includes stacking of the magnetic material bodies in a direction perpendicular to a plane of each magnetic material body in such a manner that at least one of each adjacent pair of the magnetic material bodies has the bonding thin layer, which faces the other of each adjacent pair of the magnetic material bodies.

17. A method according to claim 9, wherein:

each magnetic material body is in a form of a particle; and the constructing of the structure includes sintering of the magnetic material bodies.

18. A method for manufacturing a magnetic member for an electromagnetic driving device, the method comprising:

constructing a structure, which has a predetermined shape, from a plurality of magnetic material bodies; and joining adjacent ones of the magnetic material bodies together in such a manner that a corresponding oxidized thin layer is interposed between the adjacent ones of the magnetic material bodies, wherein each oxidized thin layer has a volume resistivity greater than that of iron, wherein the joining of the adjacent ones of the magnetic material bodies includes:

placing the structure in an enclosed space;

supplying oxygen gas into the enclosed space;

evacuating the enclosed space; and heating the structure to induce diffusion between the adjacent ones of the magnetic material bodies.

19. A method according to claim 18, wherein:

each magnetic material body is in a form of a plate; and the constructing of the structure includes stacking of the magnetic material bodies in a direction perpendicular to a plane of each magnetic material body.

20. A method for manufacturing a magnetic member for an electromagnetic driving device, the method comprising:

constructing a structure, which has a predetermined shape, from a plurality of magnetic material bodies; and joining adjacent ones of the magnetic material bodies together in such a manner that a corresponding nitrided thin layer is interposed between the adjacent ones of the magnetic material bodies, wherein each nitrided thin layer has a volume resistivity greater than that of iron, and the joining of the adjacent ones of the magnetic material bodies includes:

placing the structure in an enclosed space;

supplying nitrogen gas into the enclosed space;

evacuating the enclosed space; and inducing diffusion between the adjacent ones of the magnetic material bodies.

* * * * *